US005832629A

United States Patent [19]

Wen

[11] Patent Number: 5,832,629

[45] Date of Patent: Nov. 10, 1998

[54] SHOCK-ABSORBING DEVICE FOR FOOTWEAR

[76] Inventor: Jack Wen, 12, No. 9, Lane 6, Kuo Feng Street, Tsuo Ying, Kao Hsiung City, Taiwan

[21] Appl. No.: 758,574

[22] Filed: Dec. 3, 1996

[51] Int. Cl.[6] ..... A43B 13/18; A43B 21/26; A43B 21/30; A43B 21/32

[52] U.S. Cl. ..... 36/27; 36/28; 36/35 R; 36/38

[58] Field of Search ..... 36/27, 28, 35 R, 36/37, 38, 7.8

[56] References Cited

U.S. PATENT DOCUMENTS

| | | | |
|---|---|---|---|
| 1,112,932 | 10/1914 | Preizer | 36/38 |
| 1,261,488 | 4/1918 | Cerar et al. | 36/38 |
| 2,668,374 | 2/1954 | Seigle . | |
| 2,836,907 | 6/1958 | Windle | 36/38 |
| 3,251,145 | 5/1966 | Mack | 36/7.8 |
| 4,267,648 | 5/1981 | Weisz . | |
| 4,322,893 | 4/1982 | Halvorsen . | |
| 5,224,278 | 7/1993 | Jeon | 36/27 |
| 5,343,637 | 9/1994 | Schlinder . | |

FOREIGN PATENT DOCUMENTS

| | | | |
|---|---|---|---|
| 2407684 | 7/1979 | France | 36/37 |
| 618719 | 9/1934 | Germany | 36/38 |
| 666436 | 8/1964 | Italy | 36/38 |

*Primary Examiner*—B. Dayoan
*Assistant Examiner*—Anthony Stashick
*Attorney, Agent, or Firm*—Browdy and Neimark

[57] ABSTRACT

A footwear shock-absorbing device comprises a lower receiving member, an upper receiving member, a plurality of fastening members, and a plurality of coil springs. The lower receiving member has a flat bottom provided with a plurality of columnar projections. The upper receiving member is located on the lower receiving member and provided with a flat top in contact with a footwear pad. The fastening members are fastened respectively at one end thereof with the flat top of the upper receiving member and at another end thereof with said columnar projections. The coil springs are fitted respectively over the fastening members such that both ends of the coil springs urge the flat top of the upper receiving member and the flat bottom of the lower receiving member, so as to enable the fastening members to locate at an upper dead point at such time when the fastening members are not exerted on by an external force.

12 Claims, 4 Drawing Sheets

SHOCK-ABSORBING DEVICE FOR FOOTWEAR

FIELD OF THE INVENTION

The present invention relates generally to a footwear cushion, and more particularly to a footwear shock-absorbing device.

BACKGROUND OF THE INVENTION

The U.S. Pat. Nos. 2,668,374; 4,267,648; and 4,322,893 disclose respectively a shoe sole which is provided with a plurality of coil springs for absorbing impact. The coil springs are used to mitigate the shock in view of the fact that they can be easily made at a low cost, and that the coil springs of various specifications are always available. Nevertheless, a variety of problems often arise from the coil springs, which can not be easily located and must be provided with the rigid plates that are fastened with the free ends of the coil springs so as to prevent the stress from being concentrated on the free ends of the coil spring. Such a footwear shock-absorbing device as described above is limited in design in that it is not cost-effective, and that it can not be used in all kinds of footwear, and further that it makes a footwear uncomfortable to wear.

The U.S. Pat. No. 5,343,637 discloses a footwear shock-absorbing device capable of overcoming the drawbacks of the coil springs described above. However, this disclosure is rather complicated in construction and is therefore not cost-effective.

SUMMARY OF THE INVENTION

It is therefore the primary objective of the present invention to provide a footwear shock-absorbing device suitable for use in a variety of shoes which are available in the market place today.

It is another objective of the present invention to provide a footwear shock-absorbing device which makes use of the coil springs and is relatively simple in construction and cost-effective.

It is still another objective of the present invention to provide a footwear shock-absorbing device with a flat and smooth receiving surface for preventing the stress from being concentrated on the free ends of the coil springs.

In keeping with the principle of the present invention, the foregoing objectives of the present invention are attained by a footwear shock-absorbing device, which comprises a lower receiving member having a flat bottom mountable in the receiving cell of a footwear sole. The flat bottom is provided with a plurality of columnar projections. The device further comprises an upper receiving member having a flat top in contact with the pad of the footwear. A plurality of fastening members are disposed between the lower receiving member and the upper receiving member such that the fastening members are fastened respectively at one end thereof with the flat top of the upper receiving member, and at another end thereof with the columnar projection, and that the fastening members are respectively fitted into a coil spring. The coil spring has two ends urging respectively the flat bottom of the lower receiving member and the flat top of the upper receiving member so as to keep each of the fastening members to locate at an upper dead point at such time when the fastening members are not exerted on by an external force.

The foregoing objectives, structures, features, functions, and advantages of the present invention will be more readily understood upon a thoughtful deliberation of the following detailed description of the embodiments of the present invention in conjunction with the accompanying drawings.

DETAILED DESCRIPTION OF THE INVENTION

Figure 1:
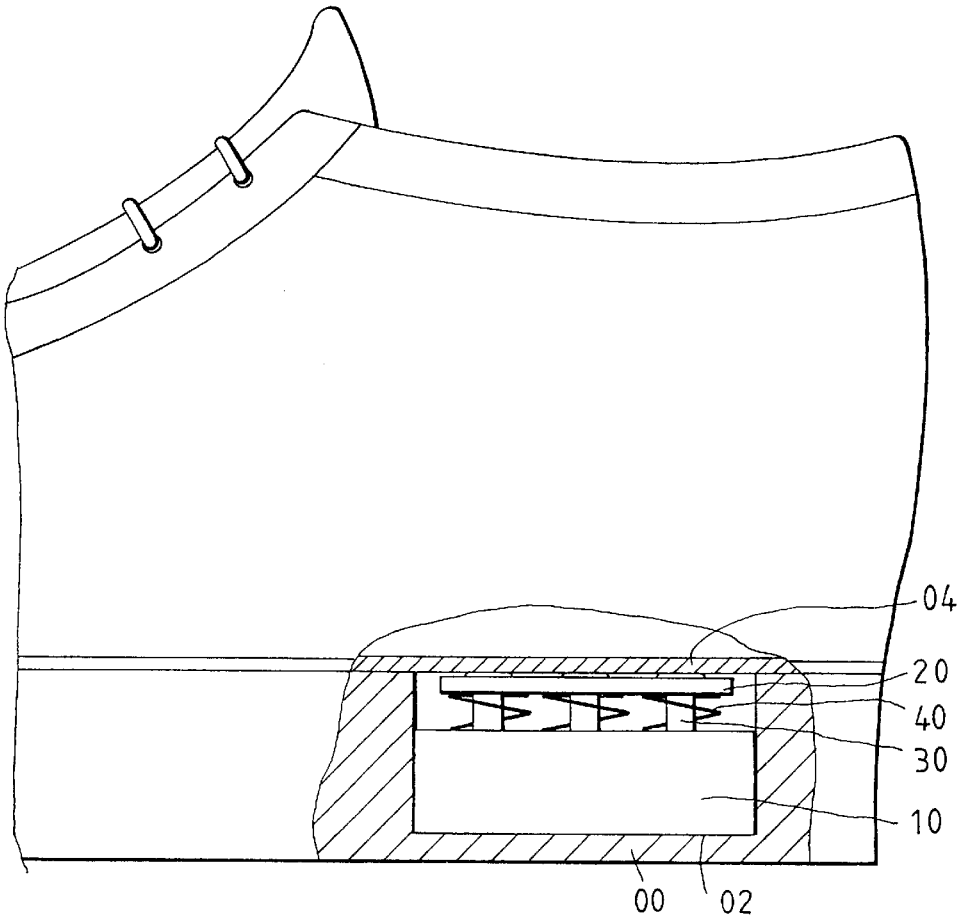
FIG. 1 shows a side elevational view of a first preferred embodiment of the present invention.
Figure 2:
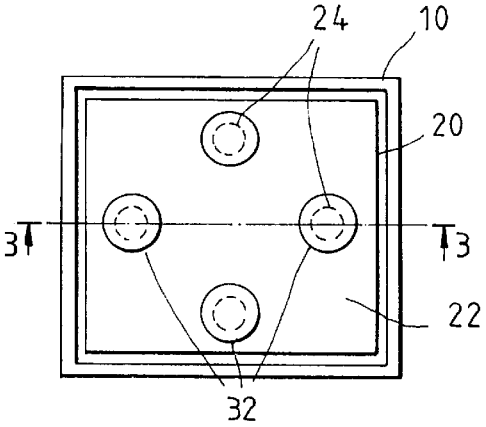
FIG. 2 shows a top plan view of the first preferred embodiment of the present invention.

As shown in FIGS. 1–4, a footwear shock-absorbing device embodied in the present invention is composed of a lower receiving member 10, an upper receiving member 20, a plurality of fastening members 30, and a plurality of coil springs 40.

The lower receiving member 10 has a flat bottom 12 capable of being located in an inner bottom 02 of the receiving cell of a footwear sole 00. The flat bottom 12 is provided with a plurality of columnar projections 14 extending upwards. Each of the columnar projections 14 has a large hole 141 extending from the bottom thereof towards the top thereof, and a small hole 143 extending from the top thereof towards the bottom thereof. Located at the junction of the large hole 141 and the small hole 143 is a flat circular face 145.

The upper receiving member 20 is located on the lower receiving member 10 and is provided with a flat top 22 on which a shoe pad 04 is mounted. The upper receiving member 20 is provided with a plurality of through holes 24 corresponding in number and location to the columnar projections 14.

The fastening members 30 are provided respectively with two stopping blocks 32 and 34, which are made integrally of a plastic material by injection molding and are inserted into the through holes 24 and the corresponding columnar projections 14 for enabling the stopping blocks 32 and 34 to be retained by the through hole 24 of the upper receiving member 20 and on the circular faces 145 of the columnar projections 10. The stopping block 34 is provided with two slots 341 and 343, which are normal to each other and arranged in a cruoiform shape.

The coil springs 40 have a free length equal to or longer than the length of the fastening members 30 and are fitted respectively over the fastening members 30 such that both ends thereof urge respectively the inner faces 16 and 26 of the two receiving members 10 and 20.

Figure 3:
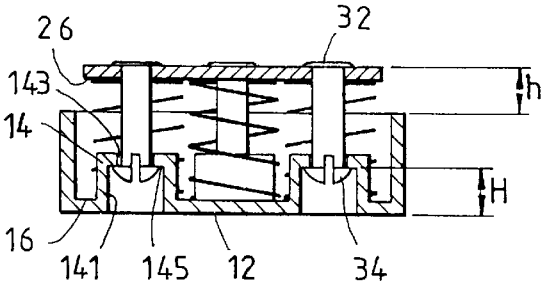
FIG. 3 shows a sectional view of a portion taken along the direction as indicated by a line 3—3 shown in FIG. 2.
Figure 4:
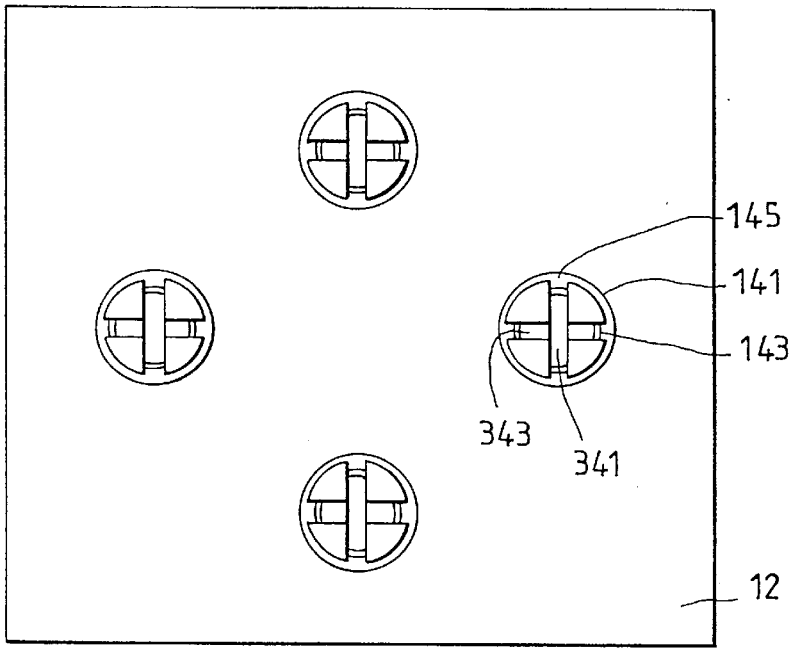
FIG. 4 shows a bottom plan view of the first preferred embodiment of the present invention.
Figure 5A:
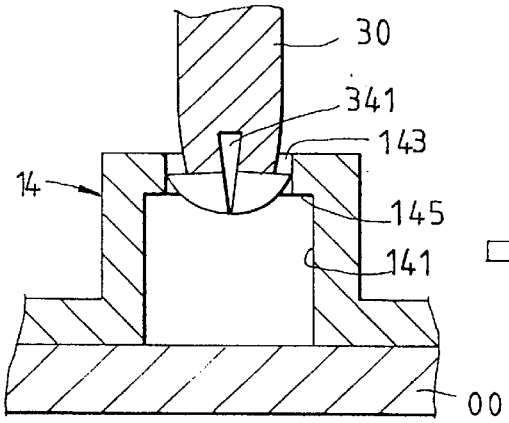
FIG. 5 is a schematic view illustrating the structure of a footwear shock-absorbing device in combination according to the first preferred embodiment of the present invention.
Figure 5B:
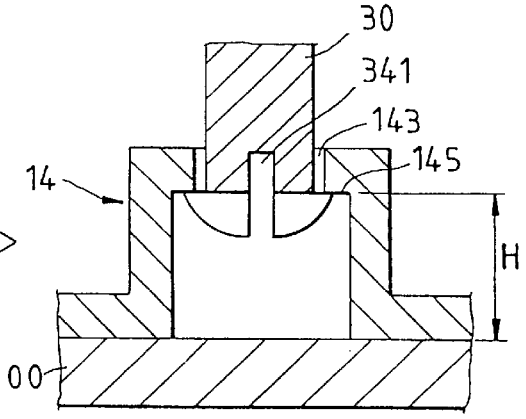
Figure 6:
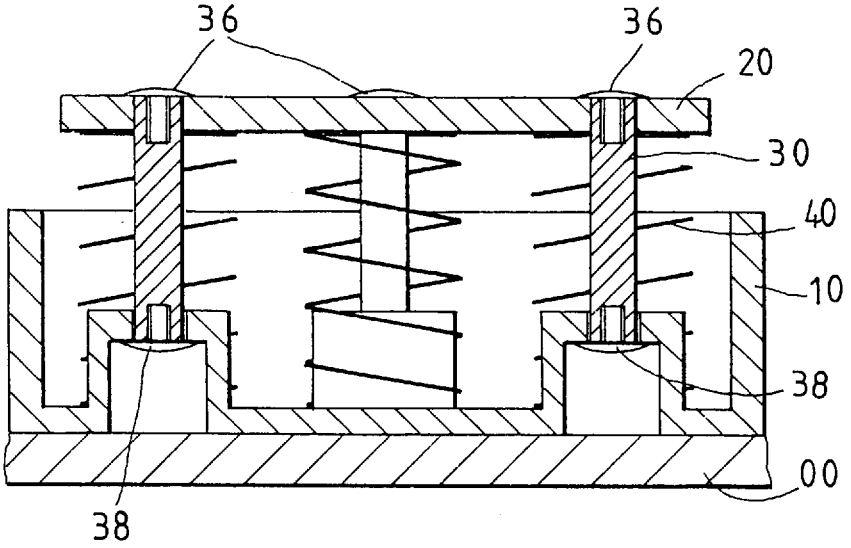
FIG. 6 shows a sectional view of a second preferred embodiment of the present invention.

As shown in FIGS. 3 and 5, the stopping block 34 located at the tail end of each of the fastening members 30 is tapered along its outer circumferential edge and is provided with the slots 341 and 343 such that the stopping block 34 of the plastic material is resilient radially, and that the stopping block 34 is capable of recovering its original shape after being forced into the through hole 24 and the corresponding columnar projection 14. The stopping block 34 is forced by the spring 40 to engage securely the flat circular face 145, thereby enabling the upper receiving member 20 and the lower receiving member 10 to join together securely as a shock-absorbing unit. The shock-absorbing unit is embedded in the footwear sole such that the spring compression stroke h is capable of mitigating the impact on a foot wearing the footwear. The compression stroke h referred to above is smaller than or equal to the depth H of the large hole 141 of the columnar projections 14. Further the fastening members 30 can be provided with two fastening bolts 36 and 38 for holding the component members together, as shown in FIG. 6.

Figure 7:
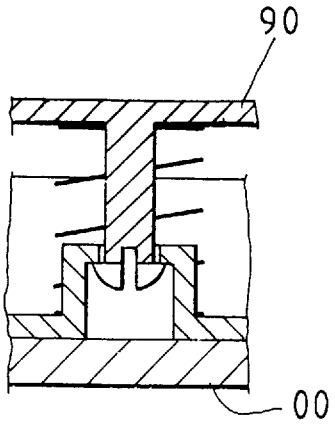
FIG. 7 shows a sectional view of a third preferred embodiment of the present invention.
Figure 8:
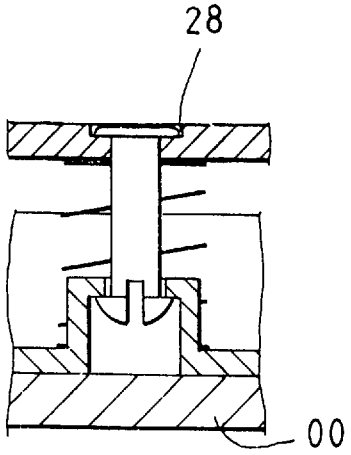
FIG. 8 shows a sectional view of a fourth preferred embodiment of the present invention.

As illustrated in FIG. 7, the upper receiving member 20 and the fastening members 30 are made integrally, as designated by 90. It is also suggested that the through hole 24 of each of the upper receiving members 20 is provided with a pillow hole 28 for averting the concentration of stress on the stopping block 32 located at the top end of each of the fastening members 30, as shown in FIG. 8.

Figure 9:
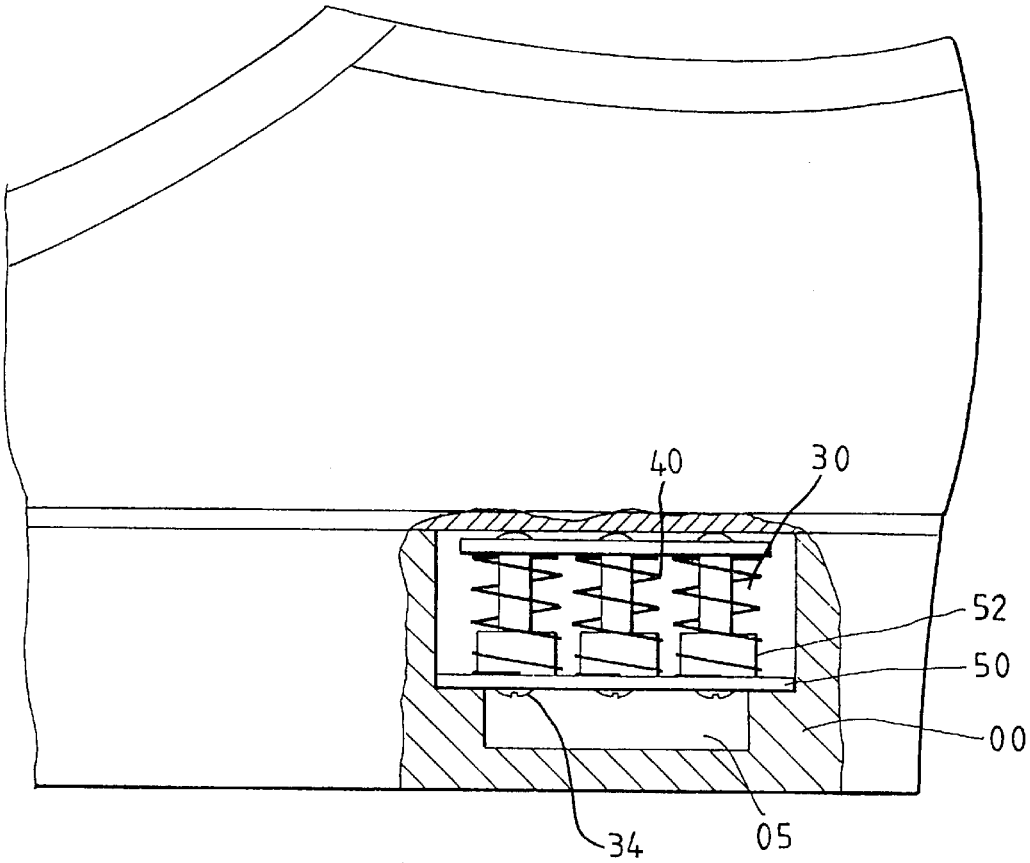
FIG. 9 shows a side elevational view of a fifth preferred embodiment of the present invention.
Figure 10:
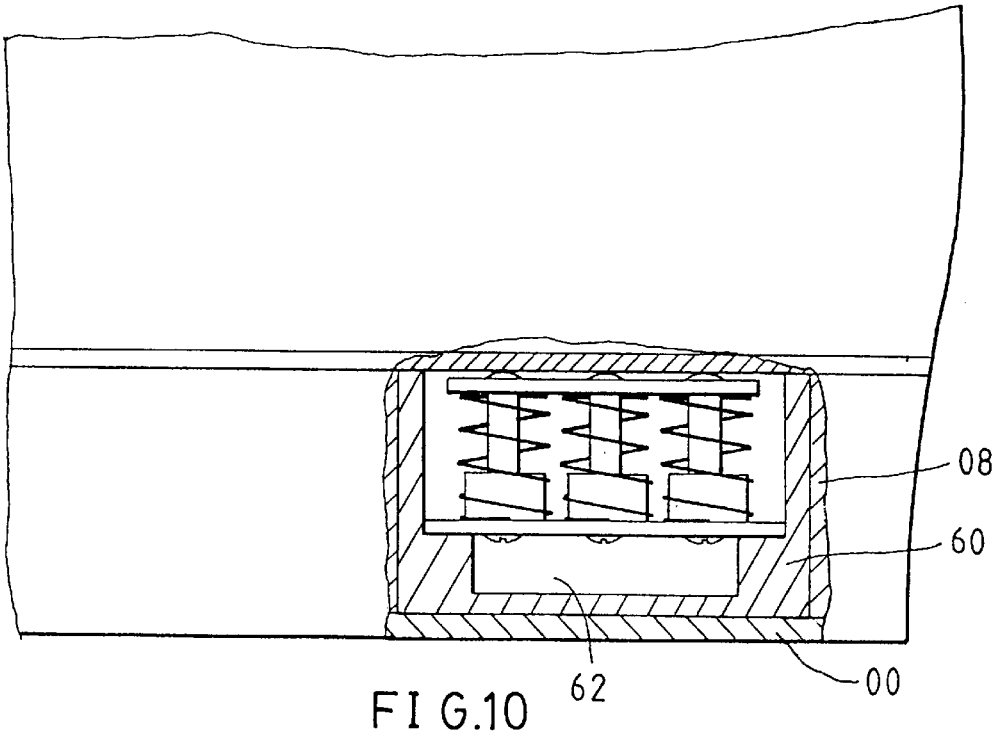
FIG. 10 shows a side elevational view of a sixth preferred embodiment of the present invention.

As shown in FIG. 9, the present invention may be embodied in such a manner that the lower receiving member 50 is provided with a plurality of columnar projections 52, and that the fastening member 30 is put through the columnar projections 52 so as to enable the stopping block 34 to engage the lower receiving member 50. Space 05 is provided below receiving member 50 to furnish room for stopping block 34 when a user compression springs 40 when walking As shown in FIG. 10, a shoe midsole 08 of a soft and elastic material is provided with a rigid base 60 for supporting the shock-absorbing device of the present invention, which is located in a receiving cell 62 of the base 60. In addition, the upper receiving member 20 of the present invention may be provided with a plurality of columnar projections extending downwards for locating the coil springs. The embodiments of the present invention described above are to be regarded in all respects as being merely illustrative and not restrictive. The present invention is therefore to be limited only by the scopes of the following appended claims.

What is claimed is:

1. A footwear shock-absorbing device comprising:

a lower receiving member provided with a flat bottom and a plurality of columnar projections of a tubular construction, said lower receiving member being disposed in a receiving cell of a footwear sole;

wherein said columnar projections are provided respectively at a bottom end thereof with a large hole and a top end thereof with a small hole, and at a junction between said large hole and said small hole with a flat circular face;

a single upper receiving member located on said lower receiving member having a single flat top in contact with a footwear pad;

a plurality of fastening members each having a first end which is fastened with said single flat top of said upper member, each of said fastening members further having a second end which is respectively slidably fitted through said small hole of said columnar projections; and wherein each said second end has a first stopping block which can engage said flat circular face;

a plurality of coil springs each being fitted over said fastening member such that both ends of said coil springs bias said single flat top of said upper receiving member away from said flat bottom of said lower receiving member; wherein said first stopper block is in engagement with said flat circular face when said fastening members are not impacted by an external force;

wherein said first stopping block is made integrally with said fastening member and is made of a plastic material by injection molding;

said first stopping block being provided in a bottom thereof with a plurality of slots of a predetermined depth;

wherein said slots have a depth greater than or equal to a thickness of said first stopping block creating sufficient flexibility to permit said first stopping block to be compressed and inserted through said small hole.

2. The device as defined in claim 1, wherein said fastening members and said upper receiving members are made integrally.

3. A footwear shock-absorbing device comprising:

a lower receiving member provided with a flat bottom and a plurality of columnar projections of a tubular construction, said lower receiving member being disposed in a receiving cell of a footwear sole;

wherein said columnar projections are provided respectively at a bottom end thereof with a large hole and a top end thereof with a small hole, and at a junction between said large hole and said small hole with a flat circular face;

a single upper receiving member located on said lower receiving member having a single flat top in contact with a footwear pad;

a plurality of fastening members each having a first end which is fastened with said single flat top of said upper member, each of said fastening members further having a second end which is respectively slidably fitted through said small hole of said columnar projections; and wherein each said second end has a first stopping block which can engage said flat circular face;

a plurality of coil springs each being fitted over said fastening member such that both ends of said coil springs bias said single flat top of said upper receiving member away from said flat bottom of said lower receiving member; wherein said first stopper block is in engagement with said flat circular face when said fastening members are not impacted by an external force;

wherein said upper receiving member is provided with a plurality of through holes corresponding in location to said columnar projections; and wherein said fastening members are provided respectively with a second stopping block on said first end respectively engaged on an outer circumferential edge of each said through holes.

4. The device as defined in claim 3, wherein said through holes are pillow holes.

5. The device as defined in claim 3, wherein said second stopping block is a bolt fastened to a top of said fastening member.

6. The device as defined in claim 1, wherein said upper receiving member is provided on a top thereof with a plurality of columnar projections extending downwards and corresponding in location to said columnar projections.

7. The device as defined in claim 3, wherein said first stopping block is a bolt fastened to a bottom of said fastening member.

8. The device as defined in claim 1, wherein said slots of said first stopping block are normal to one another in a cruciform shape.

9. A footwear comprising a footwear body and a plurality of shock-absorbing devices; wherein said footwear body comprises a sole, a pad located on said sole, and a vamp fastened with said sole for accommodating a human foot, said sole provided therein with a plurality of receiving cells for locating said shock-absorbing devices such that said shock-absorbing devices are located under said pad;

wherein said shock absorbing devices comprise:

a lower receiving member provided with a flat bottom and a plurality of columnar projections of a tubular construction, said lower receiving member being disposed in a receiving cell of a footwear sole;

wherein said columnar projections are provided respectively at a bottom end thereof with a large hole and a top end thereof with a small hole, and at a junction between said large hole and said small hole with a flat circular face;

a single upper receiving member located on said lower receiving member having a single flat top in contact with a footwear pad;

a plurality of fastening members each having a first end which is fastened with said single flat top of said upper member, each of said fastening members further having a second end which is respectively slidably fitted through said small hole of said columnar projections; and wherein each said second end has a first stopping block which can engage said flat circular face;

a plurality of coil springs each being fitted over said fastening member such that both ends of said coil springs bias said single flat top of said upper receiving member away from said flat bottom of said lower receiving member; wherein said first stopper block is in engagement with said flat circular face when said fastening members are not impacted by an external force;

wherein said first stopping block is made integrally with said fastening member and is made of a plastic material by injection molding;

said first stopping block being provided in a bottom thereof with a plurality of slots of a predetermined depth;

wherein said slots have a depth greater than or equal to a thickness of said first stopping block creating sufficient flexibility to permit said first stopping block to be compresses and inserted through said small hole.

10. The device as defined in claim 9, wherein said slots of said first stopping block are normal to one another in a cruciform shape.

11. The footwear as defined in claim 9, wherein said sole comprises a midsole having a predetermined elasticity and softness; and wherein said receiving cells are located on said midsole.

12. The footwear as defined in claim 9, wherein said receiving cells are provided therein respectively with a base; and wherein each of said shock-absorbing devices is mounted on said base.

* * * * *